US006210014B1

(12) United States Patent
Kubizne et al.

(10) Patent No.: US 6,210,014 B1
(45) Date of Patent: Apr. 3, 2001

(54) SYSTEM FOR REDUCING CONDENSATION IN ENCLOSED LAMP HOUSINGS

(75) Inventors: Peter J. Kubizne, Newark; Mark J. Courtney, Middletown, both of DE (US); David T. De Guiseppi, Chadsford, PA (US); Jason A. Cimini, Elkton, MD (US)

(73) Assignee: Gore Enterprise Holdings, Inc., Newark, DE (US)

( * ) Notice: Subject to any disclaimer, the term of this patent is extended or adjusted under 35 U.S.C. 154(b) by 0 days.

(21) Appl. No.: 09/009,486

(22) Filed: Jan. 20, 1998

Related U.S. Application Data

(63) Continuation-in-part of application No. 08/785,100, filed on Jan. 21, 1997, now abandoned.

(51) Int. Cl.[7] ..... F21V 33/00

(52) U.S. Cl. ..... 362/96; 362/294; 362/345; 362/546; 362/547

(58) Field of Search ..... 362/96, 294, 345, 362/373, 475, 477, 507, 538, 546, 547

(56) References Cited

U.S. PATENT DOCUMENTS

| | | | | |
|---|---|---|---|---|
| 3,953,566 | | 4/1976 | Gore | 264/288 |
| 3,962,153 | | 6/1976 | Gore | 260/2.5 R |
| 4,096,227 | | 6/1978 | Gore | 264/210 R |
| 4,187,390 | | 2/1980 | Gore | 174/102 R |
| 4,194,041 | * | 3/1980 | Gore et al. | 428/318 |
| 4,739,458 | | 4/1988 | Yamayoshi et al. | 362/294 |
| 4,750,093 | * | 6/1988 | Bals et al. | 362/80 |
| 4,755,917 | * | 7/1988 | Bals et al. | 362/267 |
| 4,796,163 | * | 1/1989 | Dressler | 362/61 |
| 4,802,068 | | 1/1989 | Mokry | 362/61 |
| 4,809,144 | | 2/1989 | Suzuki | 362/294 |
| 5,010,453 | | 4/1991 | Ketterman | 362/61 |
| 5,207,497 | | 5/1993 | Kamishina et al. | 362/61 |
| 5,251,111 | | 10/1993 | Nagengast et al. | 361/61 |
| 5,315,211 | | 5/1994 | Ditlevsen et al. | 315/50 |
| 5,406,467 | | 4/1995 | Hashemi | 362/294 |
| 5,416,682 | | 5/1995 | Bromhall | 362/294 |
| 5,497,308 | | 3/1996 | Ohtsuka et al. | 362/294 |
| 5,535,107 | | 7/1996 | Prok | 362/158 |
| 5,536,019 | | 7/1996 | Bryant et al. | 277/29 |
| 5,556,193 | | 9/1996 | Ferrell | 362/294 |
| 5,611,612 | | 3/1997 | Choji et al. | 362/61 |

FOREIGN PATENT DOCUMENTS

| | | |
|---|---|---|
| 2126123 | 12/1972 | (DE) . |
| 4234919 | 4/1994 | (DE) . |
| 4340710 | 6/1995 | (DE) . |
| 1560892 | 8/1984 | (SU) . |

* cited by examiner

*Primary Examiner*—Sandra O'Shea
*Assistant Examiner*—John Anthony Ward
(74) *Attorney, Agent, or Firm*—Carol A. Lewis White

(57) ABSTRACT

The invention is directed to a material and system for reducing condensation in enclosed vehicle lamp housings, and more particularly to a condensation vent comprising a water vapor material within, on or integral with the housing to reduce the condensation and prevent or minimize entry of liquid water and other foreign matter.

24 Claims, 6 Drawing Sheets

SYSTEM FOR REDUCING CONDENSATION IN ENCLOSED LAMP HOUSINGS

RELATED APPLICATIONS

The present application is a continuation-in-part of copending U.S. patent application Ser. No. 08/785,100 filed Jan. 21, 1997 now abandoned.

FIELD OF THE INVENTION

The invention is directed to a vent and system for reducing condensation in enclosed lamp housings, and more particularly to a water vapor permeable vent and method of placement of the vent within, on or integral with the housing to reduce condensation within the housing and prevent or minimize entry of liquid water and other foreign matter.

BACKGROUND OF THE INVENTION

Current vehicle head lamps, brake lamps, running lamps, turn signal lamps, fog lamps, back-up lamps and parking lamps (hereinafter referred to collectively as "lamps" or "vehicle lamps" for convenience) typically have the light bulb located in an enclosed housing of the lamp not only for aesthetic appearance, but also to prevent water, dirt, oils and the like from reaching the bulb, the reflective surfaces, and the light transmitting surfaces of the lamp. It is often the case however, that upon thermal cycling during use of the bulb, thermal cycling due to changes in the environment, or thermal cycling as a result of vehicle operation, moisture condenses on the interior of the housing and inhibits light output from the lamp.

Various venting concepts and desiccant assemblies have been used conventionally to minimize the effects of condensation build-up in enclosed lamp housings. For instance, some conventional vehicle lamps having an enclosed housing include a desiccant for preventing fog formation on the internal walls of the lamp or its reflector. The desiccant adsorbs water vapor which enters the housing when the lamp is off. When the lamp is turned on, heat generated by the bulb dries the air and the desiccant, thereby regenerating the desiccant. The desiccant is usually in the form of a housed or packaged silica gel or similar material.

Although this type of packaged desiccant provides adequate moisture adsorption under some conditions and is capable of being regenerated by the heat produced by the light bulb, a number of difficulties have been identified with these types of systems. For example, the desiccant package is not easy to position within the housing, often requiring that a special sub-housing be provided within the lamp housing. In addition, this type of packaged desiccant sub-housing cannot withstand the high temperatures generated by some light bulbs, and accordingly, the desiccant must be located at least a minimum distance from a high temperature bulb and/or shielded from the bulb.

Moreover, desiccant assemblies can add significant costs to lighting systems. New approaches which can reduce part cost and complexity are constantly being sought by manufacturers of vehicle lamps.

Vent systems that reduce condensation often employ some means of increasing airflow through the lamp housing. In general, the atmospheric air outside of a lamp housing is below the water vapor saturation point, and the air flowing through the housing has the capacity to remove condensation from the lamp housing by removing water vapor from the housing. Vent systems using this means of condensation reduction generally have vent openings in more than one location. The openings are often placed in locations where air flow past the vent opening enhances air flow through the vent openings. The location of these vent systems can be an important consideration. However, such vent systems that provide a means of increasing air flow through the lamp housing often have a negative effect on lamp performance. Particularly, these venting systems often create an opportunity for foreign materials and liquid water to enter the vehicle lighting system.

Vents have also been used within closed housings to relieve pressure build-up due to changes in environmental conditions (e.g., when the bulb(s) are energized, changes in outside temperature, etc.) while minimizing the entry of water and dirt into closed lamp housings. For example, vents that incorporate microporous materials such as expanded PTFE membranes (e.g., GORETEX® membrane vents, available from W. L. Gore and Associates, Inc., Elkton, Md.), modified acrylic copolymer membranes (VERSAPORE® membranes, available from Gelman Sciences, Ann Arbor, Mich.), and other microporous materials are commonly used to relieve pressure from lamps and have proven to be very effective means of preventing liquid water entry and entry of foreign materials in the lamp housings. As used herein, the term "microporous material" is intended to refer to a continuous sheet of material that is at least 25% porous (i.e., it has a pore volume of $\geqq 25\%$), with 50% or more of the pores being no more than about 30 micrometer in nominal diameter.

Microporous materials are sold in many configurations. For example, microporous materials are available with plastic housings that protect the material from damage and contamination, while simplifying installation. Some microporous materials are supplied with woven and/or non-woven fabrics that provide protection for the microporous material. Microporous materials with or without fabric support have been made into products that incorporate adhesives for the purpose of attaching the product to a device that is vented.

Conventional microporous vent products designed for vehicle lighting applications have addressed pressure relief, ease of installation, durability, exclusion of liquid water and foreign materials, etc. The conventional design requirements for the microporous vent area are based on maintaining low pressures within the lamp housing during thermal cycling of the lamp. The venting surface area of microporous vents is designed based on the air flow of the microporous vent material and the volume change of the air in the lamp resulting from thermal cycling.

A significant concern regarding the use of microporous vents is that the venting configurations available do not effectively remove condensation. It is common to find references in existing art that recommend small vent sizes for porous vent materials. One example is U.S. Pat. No. 4,802,068, in the name of Mokry, which teaches that "[t]he size of the opening and the composition of the element are selected to permit adequate variation in the air pressure within the chamber. The opening should not be too large however, or the rate of transmission of moisture through the seal may be unacceptably high. Conveniently the opening may be provided by a hole about 5 mm in diameter." (col. 3, lines 27–33) The microporous product designs are tested for condensation performance by exposing the lamp and vent assemblies to various temperature and humidity combinations. These tests are used to determine how well the microporous vent products will perform with respect to condensation formation and elimination.

However, it has not been taught that condensation within, on or integral with the housing can be reduced, and preferably eliminated, by providing a condensation vent comprising a water vapor permeable material of specific surface area and specific dimensions and compositions. As used herein, the term "water vapor permeable" means a material or system which permits the passage of water vapor through the material system.

Thus, to date, there has not been a satisfactory system for reducing condensation in enclosed vehicle lamp housings which combines the benefits not only of eliminating or reducing entry of liquid water and other foreign materials, but also of minimizing or eliminating the formation of condensation within a lamp housing.

Accordingly, there has been a long-felt need in the art for a system for rapidly removing and reducing the build-up of condensation in vehicle lamps.

SUMMARY OF THE INVENTION

The present invention relates to systems for reducing or eliminating condensation inside enclosed housings of vehicle lamps such as, for example, automobile, truck, motorcycle, and boat lamps. In addition, the present invention is suitable for other lighting applications where condensation on the interior of a lamp housing could detrimentally affect not only the light output, but also such other features as the cosmetic appearance of the lamp, the light bulb life, the function of the reflective surfaces, and the like.

In one embodiment, the present invention provides a condensation vent which accelerates the exchange of water vapor between the interior of a lamp housing and the atmosphere external to the lamp housing, thereby permitting the rapid removal of condensation as water vapor from the interior of the housing.

In general, the water vapor content of the atmosphere is below the water vapor saturation point. The unsaturated atmospheric condition allows water vapor to diffuse from the interior of the lamp to the exterior of the lamp if liquid water or condensation exists in the lamp. The mechanism for the water vapor flow is diffusion through a water vapor permeable material. Water vapor is free to move into or out of the lamp housing via a diffusion mechanism. It is recognized that condensation can form when a lamp housing is cooled. The rate of moisture removal from the lamp housing will be dependent on the atmospheric conditions outside the lamp and the design and materials of construction of the condensation vent. From this combination of parameters, the condensation vent system can be designed to remove water vapor from a vehicle lamp in a specified time period for a specified environmental condition, while resisting (i.e., protecting against) the entry of liquid water and other contamination into the housing.

The size of the water vapor permeable area of the condensation vent required to rapidly remove water vapor from a lamp housing at normal ambient conditions is greater than that taught in conventional pressure venting systems. Thus, the relationship between the surface area of water vapor permeable materials covering a vent opening and water vapor transfer has been unexplored in the conventional art as a means of reducing and eliminating condensation from vehicle lamps. As used herein, the "vent opening" shall be defined as the total cross-sectional area of one or more openings that are covered by the water vapor permeable material of the condensation vent. The cross-sectional area is calculated based on the area of the opening immediately adjacent to the water vapor permeable material. The one or more openings may be present in any part of the lamp housing.

In a preferred embodiment of the present invention, the novel condensation venting systems comprise water vapor permeable materials covering venting opening areas greater than 132 $mm^2$, which accelerate the removal of condensation from vehicle lamps while providing protection from entry of foreign materials and liquid water. The novel optimized surface areas of the water vapor permeable materials permit rapid removal of condensation from the vehicle lamps.

Suitable water vapor permeable materials for the condensation vents of the present invention may include either porous materials, such as microporous materials, or alternatively, nonporous materials which are capable of water vapor diffusion therethrough. These materials may be in any number of forms, such as wovens, nonwovens, foams, sintered particles, films or membranes, in either monolithic or composite form. Moreover, depending on the composition of the materials, it may be desirable to provide a water-resistant device or coating to one or more sides of the materials. In a preferred embodiment, the water vapor permeable material may be inherently water-resistant. As used herein, the term "water-resistant" shall mean protecting against the entry of liquid water or water-based liquid into the housing.

BRIEF DESCRIPTION OF THE DRAWINGS

The operation of the present invention should become apparent from the following description when considered in conjunction with the accompanying drawings, in which.

DETAILED DESCRIPTION OF THE INVENTION

Figure 1:
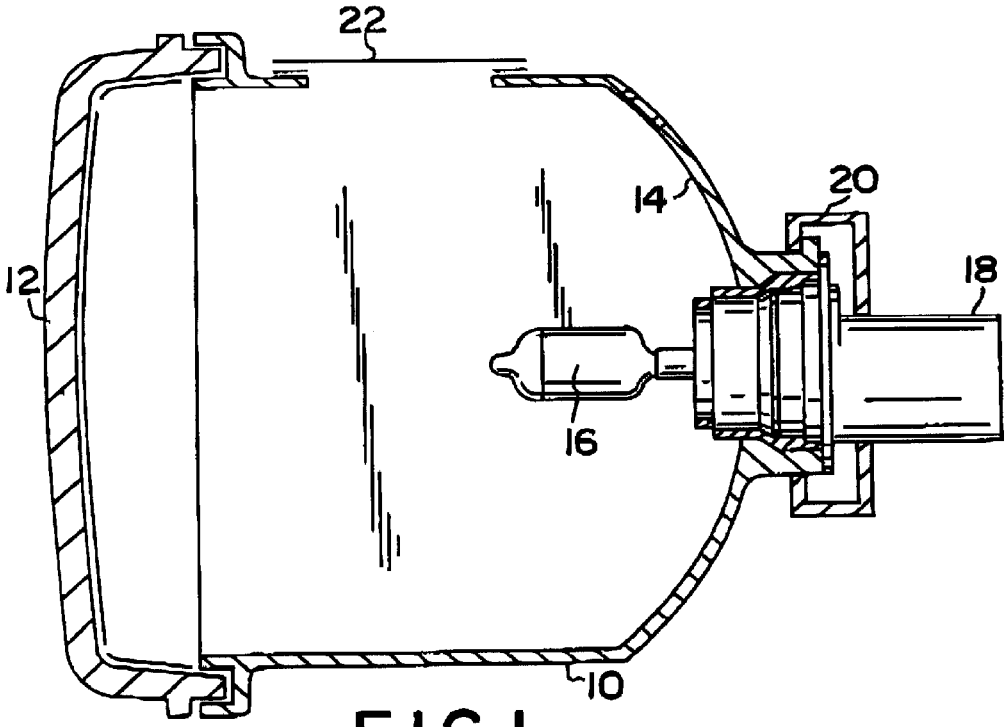
FIG. 1 is cross-sectional view of an enclosed vehicle lamp incorporating a condensation vent of the present invention.

The present invention relates to systems for reducing or eliminating condensation inside enclosed housings of vehicle lamps such as, for example, automobile, truck, motorcycle, and boat lamps. In addition, the present invention is suitable for other lighting applications where condensation on the interior of the housing could detrimentally affect not only the light output, but also such other features as the cosmetic appearance of the lamp, the light bulb life, the function of the reflective surfaces, and the like.

The enclosed vehicle lamp housings suitable for the present invention may comprise one enclosed chamber or multiple enclosed chambers attached together. Alternatively, the enclosed vehicle lamp housing may comprise multiple chambers which are separated by partial walls or partitions, whereby such walls or partitions do not isolate these chambers from one another, and air can pass between the chambers. Moreover, suitable vehicle lamp housings may comprise either front lamps (i.e., located on the front of a vehicle, such as head lamps, turn signal lamps, running lamps, fog lamps, and the like) or rear lamps (i.e., located on the rear of the vehicle, such as running lamps, brake lamps, back-up lamps, turn signal lamps, rear fog lamps, and the like).

Depending on the location of the vehicle lamps on the vehicle, the environments to which the lamps are exposed can vary considerably, thus impacting the design requirements for the condensation vents of the present invention. As an example, lamps located at the front of the vehicle typically experience higher air flow when the car is in motion than lamps located at the rear of the vehicle. Further, the light output from the light bulb(s) located within a lamp can vary significantly. For example, head lamps typically contain higher wattage bulbs than turn signal lamps; however, the frequency of use of lamps also impacts the environmental conditions of the lamps. Heat from the vehicle's engine can have a significant effect on the environmental conditions that a lamp in the front of a vehicle is exposed to compared to most rear lamp applications. Thus, with respect to the performance of the condensation vents and condensation reducing systems of the present invention, many factors must be taken into account. Accordingly, a range of condensation vent designs and sizes are contemplated in the present invention.

Particularly preferred condensation reducing vent systems for front lamps in vehicles have been determined to comprise an enclosed lamp housing having at least one vent opening with a total vent opening area of at least 132 mm and a condensation vent comprising at least one water vapor permeable material covering said at least one vent opening, whereby the condensation vent permits water vapor within the lamp housing to pass out of the housing and resists the entry of liquid water and contaminants into the housing. In an even further preferred embodiment, condensation vents with total vent opening areas of at least 570 $mm^2$ have been shown to provide even more effective condensation reduction within an enclosed front lamp housing.

Particularly preferred condensation reducing vent systems for rear lamps in vehicles have been determined to comprise an enclosed lamp housing having at least one vent opening with a total vent opening area of at least 235 $mm^2$ and a condensation vent comprising at least one water vapor permeable material covering said at least one vent opening, whereby the condensation vent permits water vapor within the lamp housing to pass out of the housing and resists the entry of liquid water and contaminants into the housing.

These novel improved condensation vents and condensation systems accelerate the removal of condensation from vehicle lamps, while providing protection from entry of foreign materials and water, and optionally, providing a means of relieving pressure from the lamp housing. The novel optimized surface areas of the water vapor permeable materials permit significant reductions in the time required to remove condensation from the lamps containing the condensation vents as compared to conventional enclosed lamps.

As shown in cross-section in FIG. 1, a typical enclosed automotive lamp incorporating a condensation vent of the present invention comprises a housing 10, a lens 12, a reflector region 14 integral with the housing 10, a bulb 16, a socket 18 and a bulb/socket locking unit 20. A condensation vent or vents 22 of the present invention may be located along a portion of the housing 10.

In one embodiment of the present invention, the condensation vent comprises a liquid water-resistant, water vapor permeable material which resists liquid water and other contaminants from passing through the material, but permits water vapor to pass freely. Alternatively, the condensation vent may comprise a liquid water permeable, water vapor permeable material in combination with a suitable cover device, either attached to or molded to the lamp housing, which resists liquid water and contaminants from reaching the vent material, while still permitting water vapor to pass freely. Exemplary cover materials may include, but are not limited to, channels, tubes, baffles, or the like.

Figure 2:
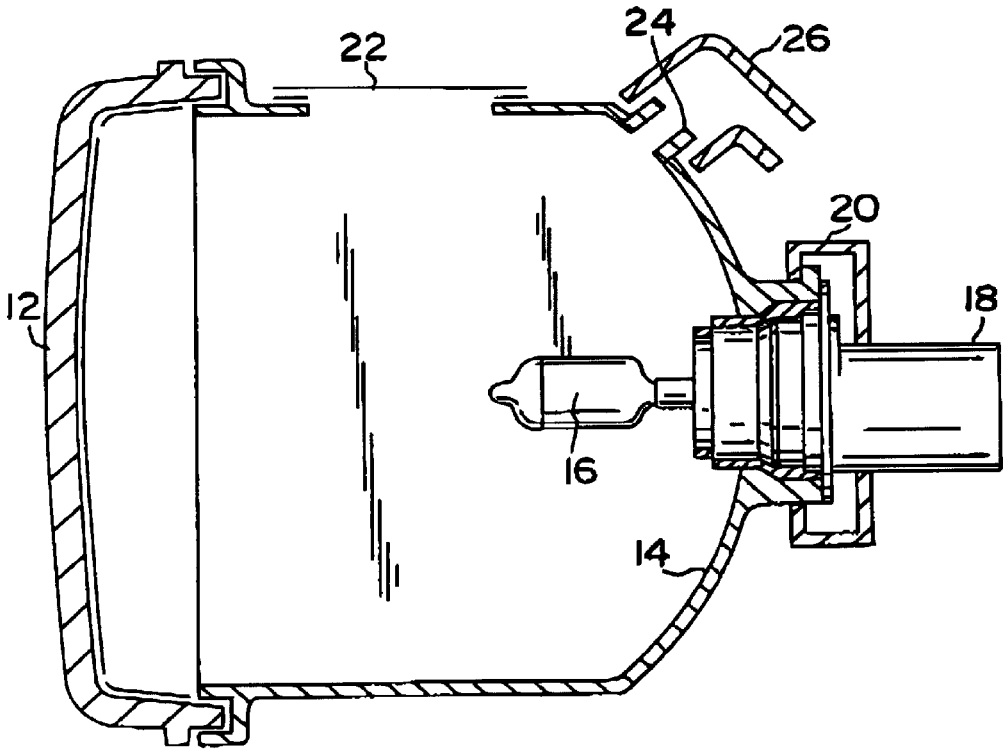
FIG. 2 is cross-sectional view of an enclosed vehicle lamp incorporating a condensation vent and a boss and tube vent of the present invention.
Figure 3:
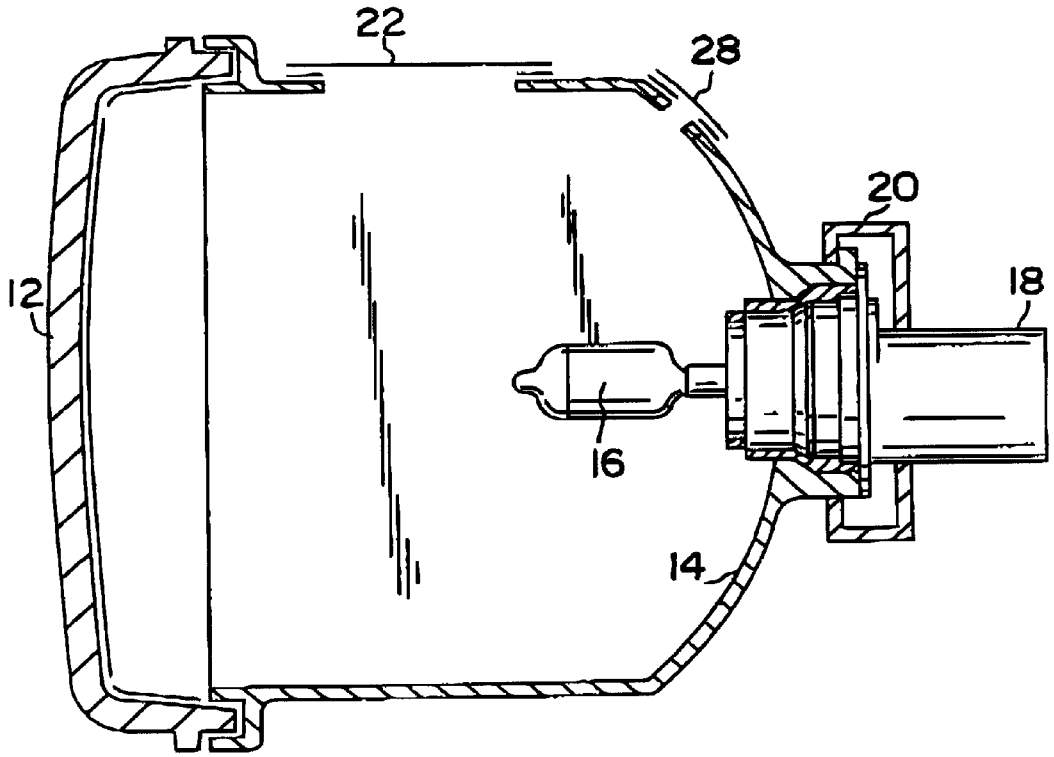
FIG. 3 is cross-sectional view of an enclosed vehicle lamp incorporating a condensation vent and a microporous vent of the present invention.

In another embodiment of the present invention, the condensation vent may comprise a water vapor permeable, air and liquid water impermeable material (i.e., impermeable to the passage or flow of air or liquid therethrough), whereby the water vapor passes through the material via diffusion. One example of such a water vapor permeable, air and liquid impermeable material comprises an expanded PTFE membrane having a urethane coating thereon, such as that described in U.S. Pat. No. 4,194,041, to Gore et al., incorporated herein by reference. In such an embodiment, because the condensation vent is air impermeable, it may be desirable to provide one or more additional vents within the headlamp housing to reduce pressure within the enclosed housing. For example, as shown in FIG. 2, there is provided, in addition to the components identified with respect to FIG. 1, a boss 24 and tube 26 vent which relieves pressure within the housing. Alternatively, as shown in FIG. 3, it may be desirable to provide a microporous vent 28 in combination with the condensation vent 22 in order to reduce pressure within the enclosed housing, while still minimizing entry of liquid water or other contamination.

The novel condensation vents of the present invention may comprise any suitable water vapor permeable materials, including either porous materials, such as microporous materials, or nonporous materials which are capable of water vapor diffusion therethrough, and may be used in any number of forms, such as wovens, nonwovens, screens, scrims, foams, films, membranes or sintered particles, capillary pore membranes in which the pores are etched-out tracks formed by irradiation with high energy particles, in either monolithic or composite form, and combinations thereof. Moreover, depending on the composition of the system and materials, it may be possible to provide a water-resistant coating to one or more sides of the materials.

The water vapor permeable materials may include, but are not limited to, expanded polytetrafluoroethylene (PTFE), sintered PTFE, foamed silicone, ultrahigh molecular weight polyethylene, modified acrylic copolymers, polyesters, urethanes, polycarbonate, polyimide, polyvinyl fluoride, polyvinylidene fluoride, polypropylene, polyethylene, metals, natural or synthetic fabrics, foams, sponges, combinations of these materials, and the like. In a further alternative embodiment, it may be desirable to provide one or more properties to the materials, such as oleophobicity (i.e., repelling oils while allowing the passage of gases) or hydrophobicity (i.e., repelling water while allowing the passage of gases), either as coatings on regions of the materials or as inherent characteristics of the materials to further enhance the performance of the condensation vent materials and systems of the present invention.

In a particularly preferred embodiment of the present invention, the condensation vent of the present invention comprises a water vapor permeable, liquid water-resistant expanded PTFE, such as that produced through the methods described in U.S. Pat. No. 3,953,566, to Gore, U.S. Pat. No. 3,962,153, to Gore, U.S. Pat. No. 4,096,227, to Gore, and U.S. Pat. No. 4,187,390 to Gore, each incorporated herein by reference.

In a further embodiment of the present invention, depending on the desired construction of the condensation vents, it may be desirable to provide one or more support materials in combination with the water vapor permeable material to enhance the strength of the materials. Suitable support materials include, but are not limited to, nylons, polyesters, polypropylenes, polyethylenes, urethanes, and the like. The support structure may comprise a fabric, a screen, a scrim, a grid, a nonwoven, sintered particles, capillary pore membranes, or the like, and may cover an entire surface of the water vapor permeable layer, or only selected regions of the water vapor permeable layer. The water vapor permeable materials may be affixed or laminated to the support materials by any number of techniques, such as adhesively bonding, sonic welding, thermally bonding, mechanically bonding, or the like, and the materials may be bonded over their entire surface or only in selected regions.

The condensation vents may be incorporated within, on or in the lamp housings by any suitable means, such as adhesively applying them to the housing, thermal bonding of the materials to the housing, ultrasonically welding of the materials to the housing, incorporating the materials within a frame or support for incorporation with the housing, other means of mechanically attaching the material to the housing, or any combination thereof. Exemplary adhesive materials which may be used in the present invention include acrylics, silicones, urethanes, including polyurethanes, butyl rubbers, hot melt adhesives, cyanoacrylates, combinations thereof, and the like.

Figure 4:
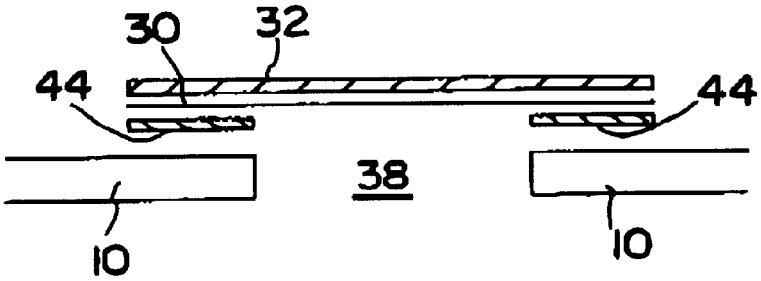
FIG. 4 is a side elevational view of a condensation vent of the present invention.

In a particularly preferred embodiment, the present invention comprises a condensation vent comprising expanded PTFE with a liquid water-resistant, water vapor permeable area of greater than 132 $mm^2$ adhesively applied to a lamp housing. As shown in a side cross-sectional view in FIG. 4, the vent comprises an expanded PTFE membrane 30 laminated to a support material 32 having areas of adhesive 44 adhering the membrane side 30 of the laminate to the edges of the lamp housing 10 surrounding the opening 38 in the housing. In a further preferred embodiment, the expanded PTFE membrane may comprise either an oleophobic or a hydrophobic surface.

Figure 5A:
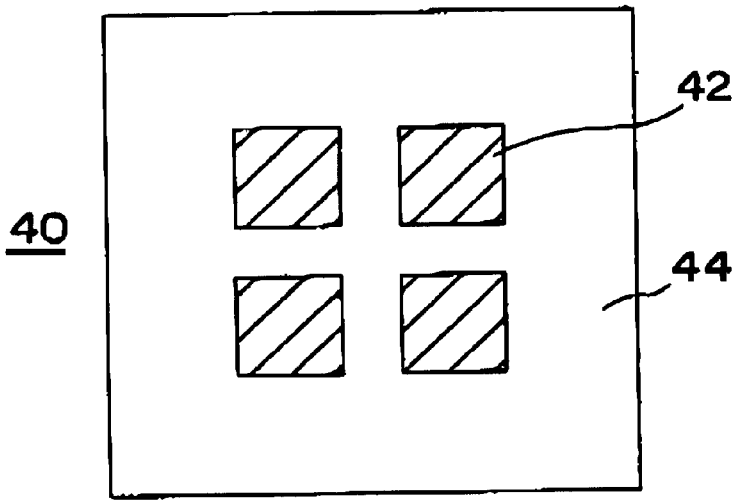
FIG. 5A is a bottom view of a condensation vent of the present invention.
Figure 5B:
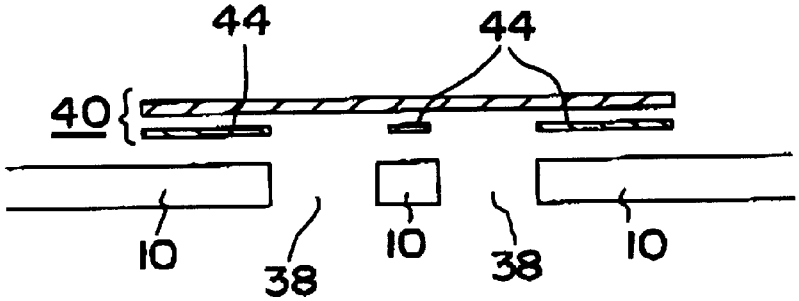
FIG. 5B is a side elevational view of a condensation vent of the present invention containing multiple regions of water impermeable, water vapor permeable material.

In another embodiment of the present invention, it may be desirable to provide the condensation vent comprising the water vapor permeable area greater than 132 $mm^2$ as either a single opening or as multiple openings within, on or in the housing. For example, depending on, e.g., the amount of force which the vent is exposed to during use, it may be desirable to provide instead of a single large area greater than 132 $mm^2$, multiple areas of water vapor permeable regions which are reinforced with either regions of the housing or with a suitable support material, thus enhancing the strength of the vent and minimizing potential deformation of the vent due to external forces. For example, as shown in FIG. 5A, it may be possible to provide a condensation vent 40 which contains multiple regions 42 of liquid water-resistant, water vapor permeable material, surrounded by adhesive material 44 which attaches to the lamp housing. As shown in cross-section in FIG. 5B, the condensation vent 40 is adhered by the adhesive 44 to multiple openings 38 within the lamp housing 10.

Figure 6:
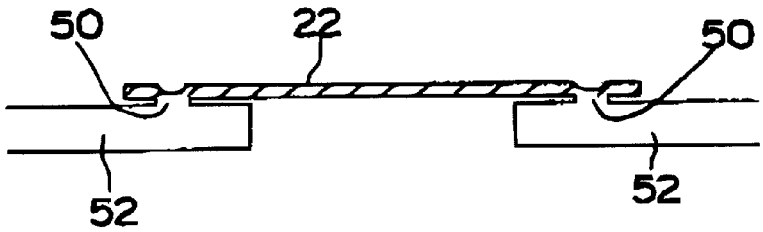
FIG. 6 is a side elevational view of a condensation vent of the present invention.
Figure 7:
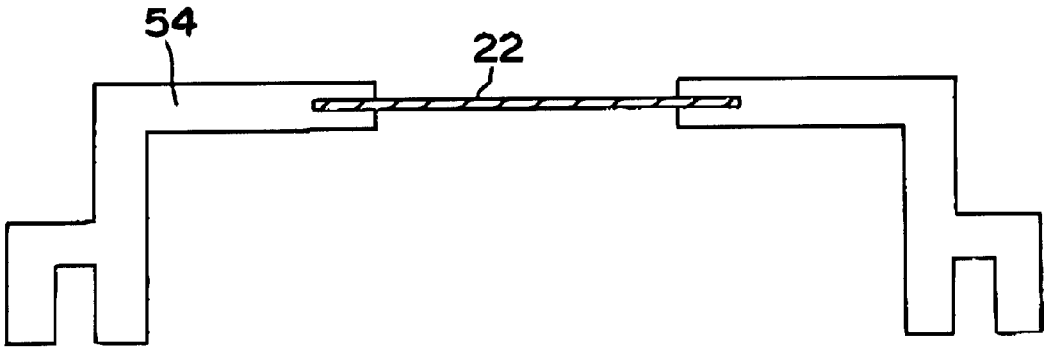
FIG. 7 is a side cross-sectional view of a condensation vent comprising a subassembly for incorporation into a vehicle lamp housing.
Figure 8:
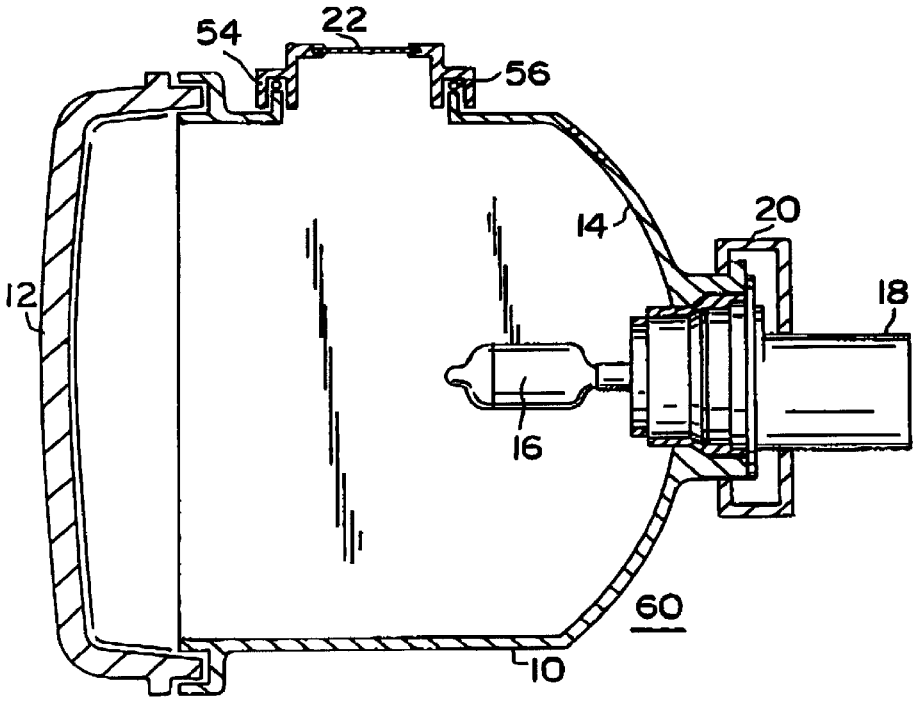
FIG. 8 is a side cross-sectional view of an enclosed vehicle lamp incorporating the subassembly shown in FIG. 7.

As mentioned earlier herein, the condensation vent of the present invention may be affixed to the lamp housing by any suitable means. FIG. 6 shows an embodiment of the invention wherein the condensation vent 22 is affixed to a lamp housing, such as a plastic housing 52, by a thermal bond 50, wherein the vent 22 is fused to the housing 52. Alternatively, as shown in cross-section in FIG. 7, it may be desirable to affix or entrap the water vapor permeable material 22 into a subhousing or cover 54, such as by crimping, insert molding, gluing, or any other suitable technique, and the subhousing 54 may then be affixed to or in the lamp housing, thereby enclosing the lamp housing. FIG. 8 shows the subhousing 54 and condensation vent 22 of FIG. 7 affixed to an enclosed automotive lamp 60 with an adhesive 56.

Figure 9:
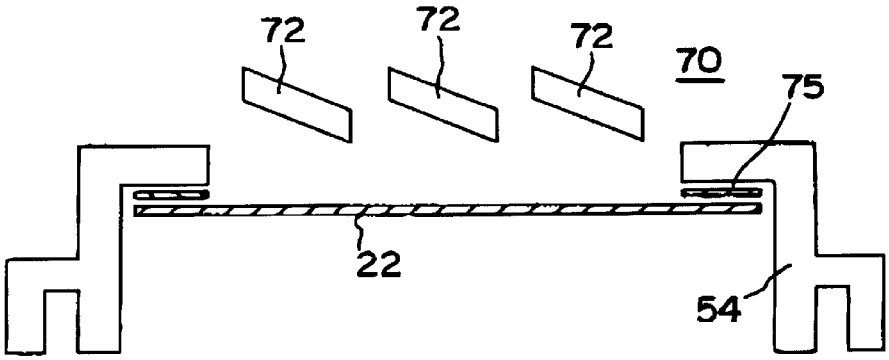
FIGS. 9 and 10 are side cross-sectional and top views, respectively, of an alternative assembly of a condensation vent of the present invention.
Figure 10:
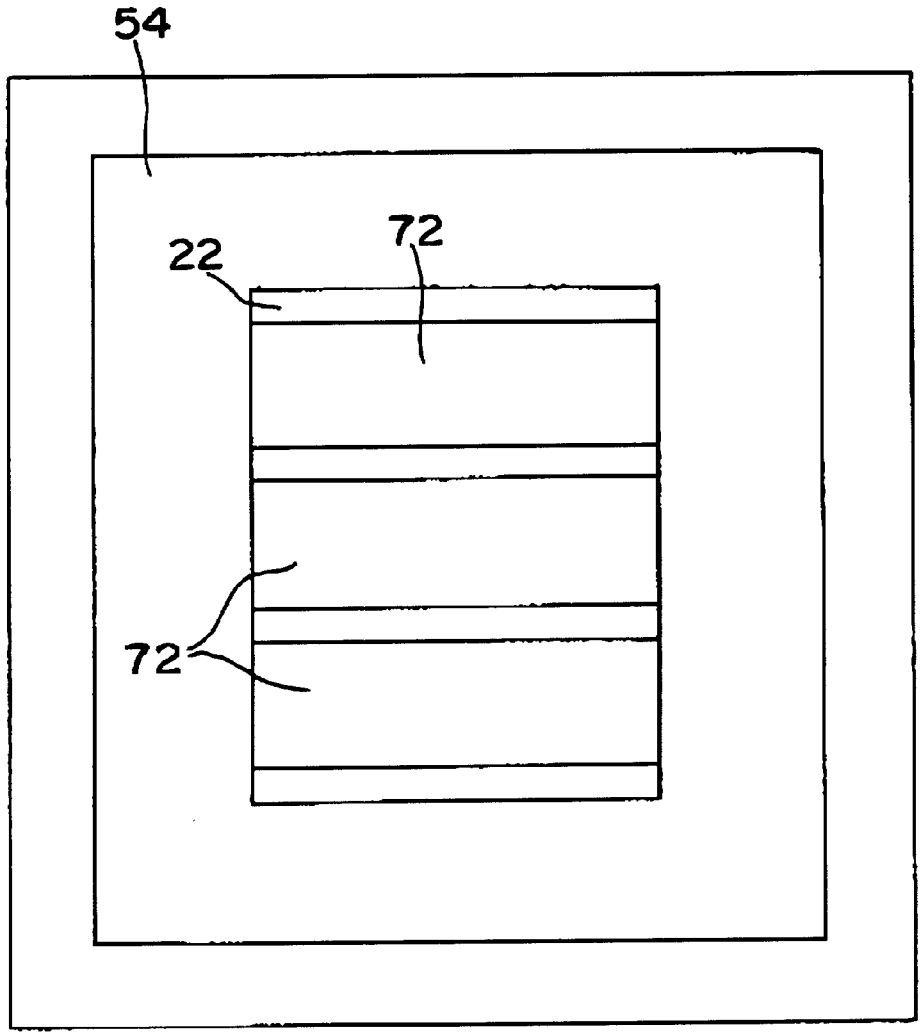

In addition to the condensation vent, it may also be desirable to include at least one other device within the enclosed housing, depending upon the conditions which the lamp is subjected to during use, the desired performance of the lamp, etc. For example, it may be desirable to include a device which increases air flow over the surface area of the water vapor permeable material. Suitable devices may include channels, tubes, baffles, or other similar devices which control air flow across the surface of the condensation vent. FIGS. 9 and 10 show a side cross-sectional view and top view respectively, of a baffle device comprising louvers which control the flow of air over the condensation vent. Specifically, the baffle 70 comprises louvers 72 in a subhousing 54 to direct air over the condensation vent 22 which is adhered to the housing with adhesive 75. The subhousing 54 may be attached to a vehicle lamp in the same manner shown in FIG. 8. A further added benefit to such a device is that the device can protect the water vapor permeable material from damage due to, for example, compromise of the membrane during installation, repair, or other impact. For the purpose of determining the vent opening of the device shown in FIGS. 9 and 10, the opening is calculated based on the area of the opening immediately adjacent to the water vapor permeable material of the condensation vent, not based on the cross-sectional area of the openings created by the louvers or baffles. The one or more openings that are covered with water vapor permeable material may be present in any part of the lamp housing.

Without intending to limit the scope of the present invention, the following examples illustrate how the present invention may be made and used:

Condensation Elimination Test Procedure

In each of the Comparative Examples 1 and 2 and Examples 1–3, the same equipment and test procedure were used to determine the time required for condensation elimination from automotive lamps.

Front vehicle lamps for the 1996 DODGE® INTREPID® automobile (Chrysler Corporation, Auburn Hills, Mich.) were used for these tests. These front vehicle lamps have a single chamber. The lamps incorporate a single bulb which functions as the headlight high and low beam. The test procedure was as follows:

1) The vehicle lamps were modified as described in the individual examples.
2) The lamps were placed in an environmental chamber with a relative humidity of greater than 90% and a temperature of 40° C.±2 for 2 hours. The environmental chambers were Blue M Model Number FR-251BMPX-189, LRH-361EX219 or FR-361C-1, as noted in each example. The light bulbs were removed from the lamp housing during this time period. This opening in the lamp allowed the lamp to equilibrate with the chamber environmental condition.

3) After the 2-hour hold in the environmental chamber, the light bulbs were installed in the housing and the lamps were removed from the chamber. The lamp lenses were then dipped into water at a temperature of 10° C.+0° C., −3° C. for 1 minute. Condensation formed on the lamp lenses as the lamp lenses were cooled by the water.

4) The lamps were then placed in a humidity-controlled lab area. The lab area had a relative humidity between 40 and 60% and a temperature of 21±3° C. The lamps were placed on fixtures for observation. The time required for clearing (i.e., for all visible condensation to evaporate from the internal lamp surfaces) was recorded.

COMPARATIVE EXAMPLE 1

The production configuration of the 1996 DODGE® INTREPID® forward lamp was used for comparison to other configurations. The production configuration of the INTREPID® lamp has a single vent on the back side of the lamp housing in the high corner of the lamp housing. This vent is manufactured by ITW Filtration Products, Frankfort, Ill. (hereinafter "ITW" for convenience). It is an injection molded part with a Versapore® R membrane (Gelman Sciences, Ann Arbor, Mich.) insert molded into a housing. The injection molded part is designed to snap fit into the lamp housing. The area of membrane exposed to the lamp interior is approximately 16 $mm^2$.

The time required for the lamp to clear with this configuration in the test method described above (Chamber Model FR-251BMPX-189) was greater than 10 hours.

COMPARATIVE EXAMPLE 2

For this example, a 1996 DODGE® INTREPID® forward lamp was modified as follows:

1) The ITW vent was removed.

2) The approximately 7.3 mm diameter hole that the ITW vent had been inserted in was covered by an adhesive patch having an outside diameter of 12.7 mm and an exposed membrane area of 38.5 $mm^2$. The adhesive patch is made with a woven nylon taffeta supported oleophobic expanded PTFE membrane and an acrylic pressure sensitive adhesive, commercially available from W. L. Gore & Associates, Inc., Elkton, Md., under the part number designation VE0012GMC.

The time required for the lamp to clear with this configuration in the test method described above (Chamber Model FR-251BMPX-189) was greater than 10 hours.

EXAMPLE 1

For this example a 1996 DODGE® INTREPID® forward lamp was modified as follows:

1) The ITW vent was removed.

2) The hole that the ITW vent had been inserted in was sealed with silicone chalk.

3) Two holes of 19.1 mm diameter were drilled into the housing. One hole was drilled into the top of the housing, and the second was drilled into the bottom of the housing.

4) The holes were covered with adhesive patches made with a woven nylon taffeta supported oleophobic expanded PTFE membrane and an acrylic pressure sensitive adhesive. The condensation vent was made from an expanded PTFE laminate material having the commercial part number VE0001PTN, available from W. L. Gore & Associates Inc., Elkton, Md. The acrylic adhesive is a product of 3M, Scotch™ 468MP Hi Performance Adhesive. The outside diameter of each component of the condensation vent was 38.1 mm. The area of each vent opening, and thus the exposed membrane area of each vent component, was 285 $mm^2$. The total vent opening area was 570 $mm^2$.

The time required for the lamp to clear with this configuration in the test method described above (Chamber Model FR-251BMPX-189) was about 2.5 hours.

EXAMPLE 2

For this example a 1996 DODGE® INTREPID® forward lamp was modified as follows:

1) The ITW vent, having a vent opening of 16 $mm^2$, was left in the production location.

2) Two holes of 19.1 mm diameter were drilled into the housing. One hole was drilled into the top of the housing, and the second was drilled into the bottom of the housing.

3) The two holes were covered with condensation vents made with a woven nylon taffeta supported urethane coated expanded PTFE membrane and an acrylic pressure sensitive adhesive. The condensation vent was made from an expanded PTFE laminate material having the commercial part number VE0002PTN, available from W. L. Gore & Associates, Inc., Elkton, Md. The acrylic adhesive is a product of 3M, Scotch™ 468MP Hi Performance Adhesive. The outside diameter of each water vapor permeable component of the condensation vent was 31.8 mm. The area of each vent opening, and thus the exposed area of each vent, was 285 $mm^2$. The total vent opening area including the ITW vent was 568 $mm^2$.

The time required for the lamp to clear with this configuration in the test method described above (Chamber Model FR-251BMPX-189) was about 3.0 hours.

EXAMPLE 3

The following work was undertaken to evaluate the effect of condensation vent design on the resistance to pressure forces. Electronic devices enclosed in housings can generate internal pressure or vacuum as the electronic device heats and cools during normal operation within the housing.

A group of 6 condensation vent components were made with a woven nylon taffeta supported oleophobic expanded PTFE membrane and an acrylic pressure sensitive adhesive. The components were made from laminate commercial part number VE0001PTN, available from W. L. Gore & Associates, Inc., Elkton, Md. The acrylic adhesive is a product of 3M, Scotch™ 468MP Hi Performance Adhesive. The components were square in shape with corner radii of 3.2 mm. The length and width of each component was 38.4 mm, and each component had four equally sized areas of exposed membrane area. The exposed membrane areas were square in shape with corner radii of 3.2 mm. The length and width of each exposed membrane area was 11.3 mm. Adhesive covered the vent membrane surface from the perimeter of the vent to 6.3 mm inside the perimeter of the vent. Adhesive also covered a 3.2 mm wide band between the four open areas of the membrane. The shape and construction of the vents was similar to that shown in FIGS. 5A and 5B. Three of these vents were modified by placing a piece of KAPTON® polyimide film (Du Pont, Wilmington, Del.) over the 3.2 mm adhesive lengths between the four exposed areas of membrane to prevent the adhesive from bonding to test plates in the center section of the test plates. The test plates were made from aluminum. The test plates were designed so that water pressure could be applied to the membrane side of the vents at the four exposed areas of membrane and at the same time allow the entire surface area of exposed adhesive to bond to the test plates. This was accomplished by having four separate holes 11.25 mm in diameter drilled into the test plates with the proper spacing.

The test plates were sealed against a device used to generate water pressure. The membrane side of the vents were exposed to the water pressure. The pressure supplied to the vents and test plate was 0.20 atmospheres. The time required for the vents to leak water was measured and recorded. The maximum time required to develop a water leak for the vents with the Kapton® polyimide film over the adhesive lengths between the exposed membrane areas was 12 minutes and 40 seconds. The maximum time required to develop a leak for the vents without the Kapton® polyimide film was 54 minutes and 20 seconds. These results demonstrate that vent design can have a significant effect on vent pressure resistance.

EXAMPLE 4

Using the same test procedure outlined for the DODGE® INTREPID® automobile lamps, a 1997 FORD® MUSTANG® COBRA® vehicle rear lamp and a modified 1997 FORD® MUSTANG® COBRA® vehicle rear lamp were compared for condensation clearing time.

The 1997 FORD® MUSTANG® COBRA® vehicle lamp has four light bulbs for the various signal functions of the tail lamp. These four bulbs are incorporated into a single enclosed lamp housing. The lamp housing is designed such that the lamp has multiple compartments that are separated from each other to varying degrees by internal walls of the housing; however, the walls do not isolate these chambers from each other and air can pass between the various compartments. The 1997 FORD® MUSTANG® COBRA® vehicle rear lamp uses two vent tubes that incorporate reticulated foam and a baffle of the type described in U.S. Pat. No. 5,406,467, to Hashemi. The cross sectional area of this vent opening is approximately 33 $mm^2$ for each tube vent, or approximately 66 $mm^2$ total for this lamp.

A COBRA® lamp was modified such that a single hole with a vent opening area of approximately 235 $mm^2$ was cut from the lamp housing wall. The 235 $mm^2$ hole was covered with a condensation vent made from laminate commercial part number VE0001PTN, and the acrylic adhesive product 468MP Hi Performance Adhesive, as described in an earlier example. The water vapor permeable, liquid water impermeable area of the resulting condensation vent was approximately the same as the hole in the housing, i.e., 235 $mm^2$. The production vent holes for the modified lamps were left open to function in conjunction with the condensation vent.

A production and a modified lamp were subjected to the condensation elimination test (Chamber Model FR-361C-1) 3 times each. The average clear time was approximately 117 minutes for the production lamp. Average clear time for the modified lamp was approximately 50 minutes. This performance represents a reduction in clear time of greater than 50% for the modified lamps.

EXAMPLE 5

Using the same condensation elimination test procedure outlined for the DODGE® INTREPID® vehicle forward lamp, a production 1997 FORD® MUSTANG® COBRA® vehicle rear lamp and a modified 1997 FORD® MUSTANG® COBRA® vehicle rear lamp were compared for condensation clearing time as in Example 4, except that the vent tubes were blocked off in the modified lamp of this example. Specifically, the production vent tubes were removed and the vent holes were blocked with butyl rubber for this example.

A lamp was modified such that a single opening with a vent opening area of approximately 235 $mm^2$ was cut from the lamp housing wall. The 235 $mm^2$ hole was covered with a condensation vent made from laminate commercial part number VE0001PTN and the acrylic adhesive product 468MP Hi Performance Adhesive, as described in an earlier example. The water vapor permeable, liquid water impermeable area of the resulting condensation vent covered the 235 $mm^2$ vent opening in the housing.

The production lamp and the modified lamp with vents blocked off as described, were subjected to the condensation elimination test (Chamber Model LRH-361EX219) two times each. The average clear time was approximately 135 minutes for the production lamp. Average clear time for the modified lamp was approximately 63 minutes. This performance represents a reduction in clear time of greater than 50% for the modified lamps.

EXAMPLE 6

Using the same condensation reduction test procedure outlined for the DODGE® INTREPID® vehicle lamp, a production 1996 LINCOLN® TOWN CAR® headlight and turn signal lamp and a modified 1996 LINCOLN® TOWN CAR® headlight and turn signal lamp were compared for condensation clearing time. The Lincoln Town Car headlight and turn signal lamp has two light bulbs. One bulb functions as the headlamp high and low beam and the second as a turn signal. These two bulbs are incorporated into a single enclosed lamp housing. The lamp housing is designed such that the lamp has two compartments that are separated from each other by an internal wall of the housing. The wall does not isolate these chambers from each other and air can pass between these two compartments.

The production TOWN CAR® head and turn signal lamp uses two vent tubes that incorporate reticulated foam. The cross sectional area of the vent holes between the internal lamp environment and the external environment is approximately 24 $mm^2$ for each tube vent or approximately 48 $mm^2$ total for this lamp.

A TOWN CAR® head and turn signal lamp was modified such that a vent opening comprising a single hole with a cross sectional area of approximately 132 $mm^2$ was cut in the location where one of the existing tube vent holes (i.e., one of the 24 $mm^2$ vents) was located in the lamp housing wall. The 132 $mm^2$ hole was covered with a condensation vent made from laminate commercial part number VE0001PTN and the acrylic adhesive product 468MP Hi Performance Adhesive, described in an earlier example. The water vapor permeable, liquid water impermeable area of the resulting part was the same as the hole in the housing, i.e., 132 $mm^2$. The remaining production tube vent hole in the modified lamps was blocked with silicone chalk.

The production lamp and the modified lamp described were subjected to the condensation elimination test (Chamber Model FR-361C-1) four times each. Average clear times for the production lamp was approximately 365 minutes. Average clear time for the modified lamp was approximately 177 minutes. This represents a reduction in clear time of greater than 50%.

We claim:

1. A vent system for reducing condensation in enclosed vehicle front lamps, comprising:

an enclosed vehicle front lamp housing having an interior, an exterior surface, and at least one vent opening communicating between the atmosphere external to the lamp housing and the interior, with a total vent opening area of at least 132 $mm^2$; and a condensation vent comprising at least one microporous, water vapor permeable material covering said at least one vent opening, whereby said condensation vent permits water vapor passage between the interior of the lamp housing and the atmosphere.

2. The vent system of claim 1, wherein said microporous, water vapor permeable material comprises expanded PTFE.

3. The vent system of claim 1, wherein said condensation vent further comprises a support material adjacent said microporous, water vapor permeable material.

4. The vent system of claim 1, wherein said condensation vent further comprises an oleophobic material.

5. The vent system of claim 1, wherein said condensation vent further comprises a hydrophobic material.

6. The vent system of claim 1, wherein said condensation vent further comprises a urethane coating on at least a portion of the microporous, water vapor permeable material.

7. The vent system of claim 1, wherein said total vent opening area is at least 570 $mm^2$.

8. The vent system of claim 6, wherein said microporous, water vapor permeable material comprises expanded PTFE.

9. The vent system of claim 1, wherein said at least one microporous water vapor permeable material covers said vent opening by attachment to said housing through at least one means selected from the group consisting of adhesive bonding, mechanical bonding, sonic welding, insert molding and thermal bonding.

10. The vent system of claim 1, wherein said condensation vent comprises a sub-housing which attaches to said lamp housing.

11. The vent system of claim 1, wherein said condensation vent further comprises at least one device to enhance air flow across the microporous, water vapor permeable material.

12. The vent system of claim 1, wherein said condensation vent further comprises at least one device selected from the group consisting of a baffle, a tube and a cover located on the exterior surface and covering at least a portion of the microporous, water vapor permeable material.

13. A vent system for reducing condensation in enclosed vehicle front lamps, comprising:

an enclosed vehicle front lamp housing having an interior, an exterior surface, and at least one vent opening communicating between the atmosphere external to the lamp housing and the interior, with a total vent opening area of at least 132 $mm^2$; and a condensation vent comprising at least one expanded PTFE membrane having a urethane coating thereon covering said at least one vent opening, said condensation vent being attached to said lamp housing by an adhesive bond, whereby said condensation vent permits water vapor passage between the interior of the lamp housing and the atmosphere.

14. A vent system for reducing condensation in enclosed vehicle rear lamps, comprising:

an enclosed vehicle rear lamp housing having an interior, an exterior surface, and at least one vent opening communicating between the atmosphere external to the lamp housing and the interior, with a total vent opening area of at least 235 $mm^2$; and a condensation vent comprising at least one microporous, water vapor permeable material covering said at least one vent opening, whereby said condensation vent permits water vapor passage between the interior of the lamp housing and the atmosphere.

15. The vent system of claim 14, wherein said microporous, water vapor permeable material comprises expanded PTFE.

16. The vent system of claim 14, wherein said condensation vent further comprises a support material adjacent said microporous, water vapor permeable material.

17. The vent system of claim 14, wherein said condensation vent further comprises an oleophobic material.

18. The vent system of claim 14, wherein said condensation vent further comprises a hydrophobic material.

19. The vent system of claim 14, wherein said condensation vent further comprises a urethane coating on at least a portion of the microporous, water vapor permeable material.

20. The vent system of claim 19, wherein said microporous, water vapor permeable material comprises expanded PTFE.

21. The vent system of claim 14, wherein said at least one microporous water vapor permeable material covers said vent opening by attachment to said housing through at least one means selected from the group consisting of adhesive bonding, mechanical bonding, sonic welding, insert molding and thermal bonding.

22. The vent system of claim 14, wherein said condensation vent comprises a sub-housing which attaches to said lamp housing.

23. The vent system of claim 14, wherein said condensation vent further comprises at least one device to enhance air flow across the microporous, water vapor permeable material.

24. The vent system of claim 14, wherein said condensation vent further comprises at least one device selected from the group consisting of a baffle, a tube and a cover located on the exterior surface and covering at least a portion of the microporous, water vapor permeable material.

* * * * *